United States Patent [19]

Krumbach

[11] Patent Number: 4,977,715

[45] Date of Patent: Dec. 18, 1990

[54] REINFORCED-CONCRETE BUILDING ELEMENT

[75] Inventor: Guido Krumbach, Wuppertal, Fed. Rep. of Germany

[73] Assignee: Hochtief Aktiengesellschaft Vorm. Gebr.Helfmann, Essen, Fed. Rep. of Germany

[21] Appl. No.: 433,040

[22] Filed: Nov. 6, 1989

[30] Foreign Application Priority Data

Nov. 10, 1988 [DE] Fed. Rep. of Germany ..... 3838069

[51] Int. Cl.[5] ..... E04C 3/10; E04C 3/26; E04C 5/12; E04C 5/16

[52] U.S. Cl. ..... 52/223 R; 52/223 L; 52/230

[58] Field of Search ..... 52/223 R, 223 L, 225, 52/230

[56] References Cited

U.S. PATENT DOCUMENTS

| | | | |
|---|---|---|---|
| 552,268 | 12/1895 | Wood | 52/223 R |
| 3,382,680 | 5/1968 | Takano | 52/223 R |
| 3,387,417 | 6/1968 | Howlett | 52/223 R |
| 3,439,462 | 4/1969 | Suzuki | 52/223 R |
| 3,488,903 | 1/1970 | Whittaker | 52/223 R |
| 3,647,184 | 3/1972 | Vanderhurst | 52/223 R |
| 3,986,311 | 10/1976 | Muhe | 52/223 R |
| 4,094,117 | 6/1978 | Torti | 52/223 R |
| 4,449,855 | 5/1984 | Langwadt | 52/223 R |
| 4,484,425 | 11/1984 | Muller | 52/223 R |
| 4,662,134 | 5/1987 | Illgner | 52/223 R |

FOREIGN PATENT DOCUMENTS

| | | | |
|---|---|---|---|
| 1163456 | 3/1984 | Canada | 52/223 R |
| 1634248 | 6/1965 | Fed. Rep. of Germany | 52/223 R |
| 1918378 | 11/1969 | Fed. Rep. of Germany | 52/223 R |
| 1146048 | 12/1987 | Japan | 52/223 R |
| 1028814 | 12/1980 | U.S.S.R. | 52/223 R |

*Primary Examiner*—Richard E. Chilcot, Jr.
*Assistant Examiner*—Deborah McGann Ripley
*Attorney, Agent, or Firm*—Herbert Dubno; Andrew Wilford

[57] ABSTRACT

A reinforcement comprises a group of generally parallel, longitudinally extending, and transversely spaced multifilament cables extending in a concrete mass and each having a pair of longitudinally opposite ends. A respective longitudinally extending resin sheath surrounds each cable between its ends and a plurality of spacers spaced longitudinally along the cables and their sheaths hold same transversely apart with the concrete mass extending between the sheaths. An anticorrosion and antifriction agent inside each sheath surrounds each cable inside the respective sheath between the respective cable ends and a respective anchor braces each cable end against the concrete mass.

5 Claims, 3 Drawing Sheets

REINFORCED-CONCRETE BUILDING ELEMENT

FIELD OF THE INVENTION

The present invention relates to a reinforced-concrete building element. More particularly this invention concerns such an element having prestressed reinforcements seated at their ends in anchors.

BACKGROUND OF THE INVENTION

Known reinforced-concrete building elements have reinforcements constituted as individual steel rods. The anchors are constituted as individual anchor elements in each of which a respective end of a respective rod is seated. The rods must be separated or fanned at the ends for connection to the anchors. When in this arrangement the rods, with or without protective coverings, are directly imbedded in the concrete of the building element, so it is not possible to pull them out and replace them at a later date. When the concrete/steel bond is not perfect, however, the steel is subject to corrosion. On the other hand when the reinforcement rods are received in a protective sleeve which is not filled with mortar, there is also a corrosion risk.

Thus in a standard prior-art system the reinforcement rods ar bonded along their full lengths to the surrounding concrete mass, whether or not the rods are surrounded with protective sleeves. This imbedding creates a good force-transmitting connection between the steel and the concrete and also protects the steel against corrosion. If the concrete/steel bond is bad in any locations the steel is subject to corrosion. In this arrangement the steel rods can be imbedded individually or as a bundle. Since all the rods are eventually fully imbedded in concrete, there is excellent lateral force transmission at the locations where the longitudinal tension in the rods is converted into transverse force. The prestressing can be done either to the rods as a group or individually.

It is also known to use multistrand cables as reinforcement elements (see "Betonwerk plus Fertigteiltechnik", 1984, pages 239 to 244). The cables each are formed by a plurality of rods or wires and run in a protective synthetic-resin sleeve which is filled around the cables with a grease or the like serving both as lubricant and anticorrosion agent. Such cables have not been used to date for the above-described type of construction elements.

Thus with this system the cables are set during manufacture into the concrete mass and are tensioned after the concrete has hardened. Each cable is seated at each end in a respective anchor element. The grease provides long-lived protection against corrosion and almost entirely eliminates friction between each cable and the respective surrounding sleeve. This system is called bond-free prestressing and is used almost exclusively for the prestressing of panels for high-rise structures, typically as floor plates. In such construction the necessary prestressing forces are small compared to those in bridge beams. Applications are also known for beams wherein the cables are distributed next to and above one another in a regular array. The cables run in a field at small spacings that are filled with concrete, but immediately before their ends the cables fan out in order to provide space for the end anchors.

It is also known from German patent document 3,734,954 (filed 15 October 1987 and assigned to Dyckerhoff & Widmann A.G.) to put several cables together as a group in a relatively large protective sleeve and to anchor this group in a common end piece, the cables being anchored together or individually. When the sleeve is straight it can be filled before or after the prestressing with mortar, but when it is curved and there will be lateral forces created by the prestressing so that the cables must be spaced and the interstices filled with mortar before the prestressing so that the lateral forces can be transmitted by the concrete to the surrounding structure. The bundle and its sleeve remain removable when they are not bonded into the mass by concrete. Such cable-type systems are nonetheless very difficult to fill completely with concrete or mortar.

OBJECTS OF THE INVENTION

It is therefore an object of the present invention to provide an improved reinforced-concrete building element.

Another object is the provision of such an improved reinforced-concrete building element which overcomes the abovegiven disadvantages, that is where the tension elements can be removed and replaced, where there is little likelihood of corrosion of these elements, and where there is little difficulty in filling the system.

SUMMARY OF THE INVENTION

A reinforcement according to the invention comprises a group of generally parallel, longitudinally extending, and transversely spaced multifilament cables extending in a concrete mass and each having a pair of longitudinally opposite ends. A respective longitudinally extending resin sheath surrounds each cable between its ends and a plurality of spacers spaced longitudinally along the cables and their sheaths hold same transversely apart with the concrete mass extending between the sheaths. An anticorrosion and antifriction agent inside each sheath surrounds each cable inside the respective sheath between the respective cable ends and a respective anchor braces each cable end against the concrete mass. The cable ends project from the sheaths at the ends thereof and are individually seated in common end anchors. The size of the interstice between adjacent sheaths is enough to allow the concrete to completely fill in, so that this size is basically dependent on the granularity of the aggregate in the concrete of the mass.

According to this invention the sheaths are each a synthetic-resin tube. In addition the spacers are disks formed with cutouts receiving the respective cables and the disks are slidable along the cables, although means may be provided for fixing the spacers on the sheaths.. The spacers can also each comprise a plurality of respective collars that each surround a respective cable and its sheath and that transversely engage adjacent sheaths and a ring or belt surrounding the group of cables and holding same transversely together.

Each anchor according to this invention can comprise a cylindrical or frustoconical steel tube having an inner end juxtaposed with the respective ends of the sheaths and an outer end, an elastic plate hermetically engaged between the inner tube end and the respective sheath ends with the cables passing through the elastic plate, and a rigid plate at the outer tube end. The tube is filled with the same anticorrosion low-friction grease as the sheaths and the cables are anchored to the rigid plate by respective wedge-type collets as is well known in the art. Furthermore each anchor further comprises respective wedges jammed between each cable end and the respective rigid plate.

DESCRIPTION OF THE DRAWINGS

The above and other objects, features, and advantages will become more readily apparent from the following, reference being made to the accompanying drawing in which.

SPECIFIC DESCRIPTION

Figure 2:
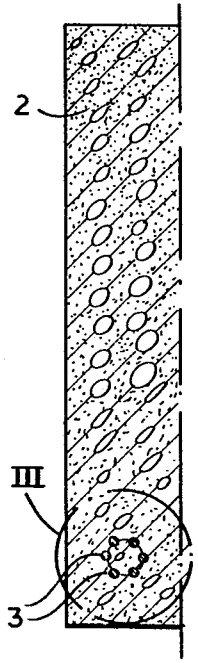
FIG. 2 a cross section taken along line II—II of FIG. 1.
Figure 1:
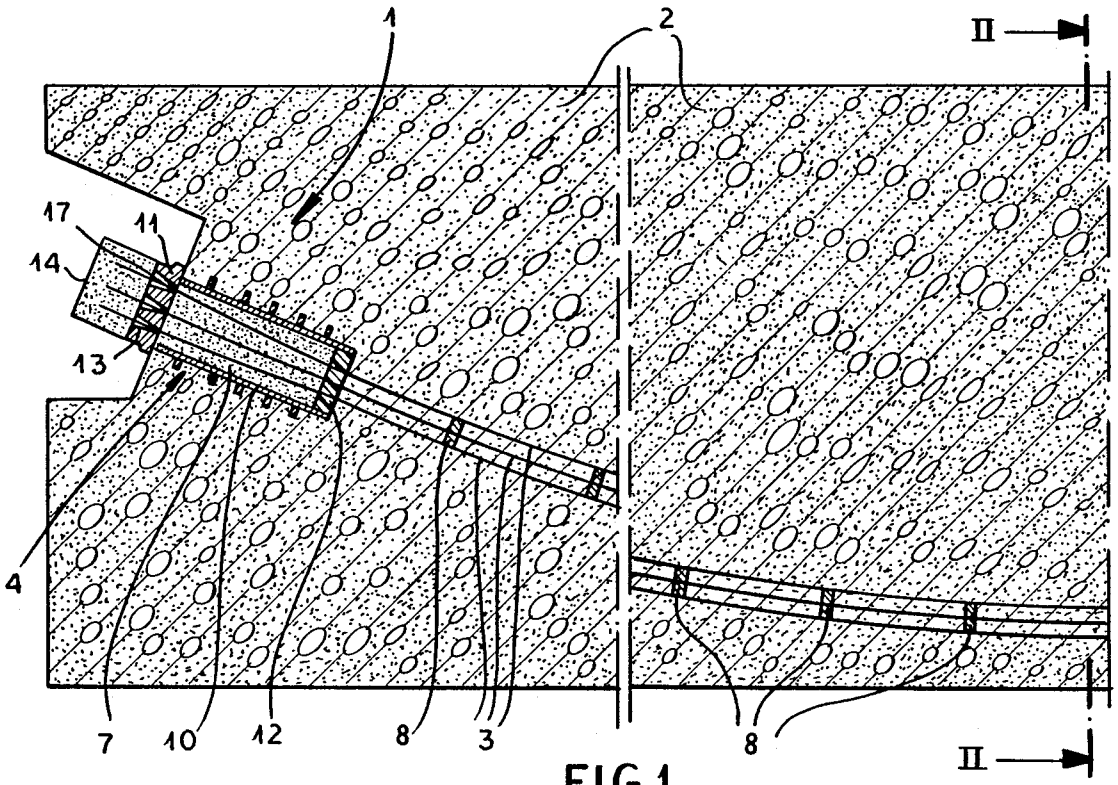
FIG. 1 is a longitudinal section through a reinforced-concrete construction element according to the invention.
Figure 3:
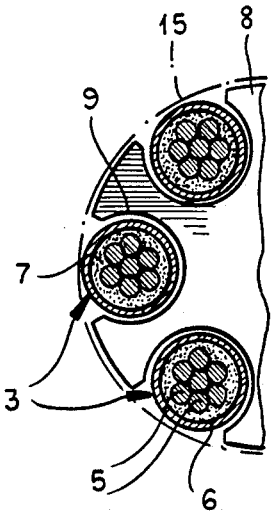
FIG. 3 is a partial view of the detail indicated at III in FIG. 2.

As seen in FIGS. 1 through 3 a reinforcement 1 for a mass 2 of concrete is constituted as a bundle reinforcement. The reinforcement 1 is comprised of a plurality of reinforcement elements 3 having ends (only one shown in FIG. 1) seated in anchors 4. The anchor 4 is of the type known per se having a wedge for each element 3.

As shown in particular in FIG. 3 the individual elements 3 are constituted as cables each having a plurality of filaments or wires 5. The wires 5 of each cable 3 are received in a respective synthetic-resin sheath 6 that is otherwise filled with a low-friction anticorrosion grease 7, so as to constitute a so-called monocable. In addition the cables 3 are provided spaced along their lengths with spacers 8 which hold these cables 3 apart while still uniting them as a bundle so that the concrete 2 can enter into the interstices between adjacent cables 3 and their sheaths 6. The ends of the cables 3 are received in the anchors 4.

According to this invention as seen in FIG. 3 the spacers 8 are each formed as a circular disk made of a durable synthetic resin, for instance a polyamide. They have holes or cutouts forming seats 9 for the individual reinforcement elements 3, these seats being of part-circular shape, angularly equispaced, and open radially outward of the center of the disk. The spacer disks 8 are slidable along the elements 3 when the system is being assembled. These spacers 8 are somewhat flexible so that the entire reinforcement 1 can be rolled up for transport to the site. The elements 3 are arranged in an orthogonal or radial pattern.

Figure 5:
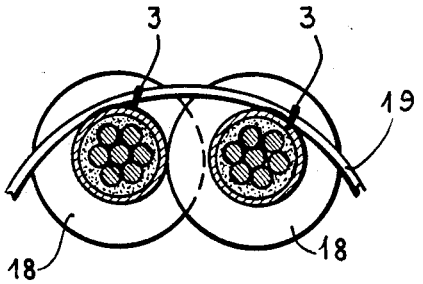
FIG. 5 is a partial cross-section through yet another system according to the present invention.

As also shown in FIG. 5 it is possible to mount rings or collars 18 around the elements 3 to hold them apart and provide an interstice that can be filled with concrete. In this case a retaining ring or tire 19 can be used to hold the bundle together, or it can even be wrapped with a helical line or the like.

As further shown in FIG. 1 the anchors 4 are each formed of a tube 10 having fins that allow it to be seated solidly in the concrete 2 and that is provided at one end with a rigid wedge plate 11 and at the opposite end with an elastic disk 12, and that is internally filled with grease 7 like the sheaths 6. The plate 11 is formed with a hole 13 for each multistrand cable 5, each such hole 13 being outwardly flared for receiving a respective locking wedge 17 of standard construction and usage. A cap 14 covers the ends of the cables 5 and the sheaths 6 engage hermetically with the plate 12.

Figure 3A:
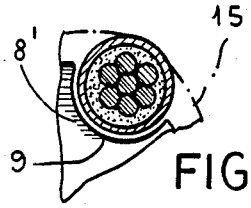
FIGS. 3A and 3B are views like FIG. 3 of variants on the system of this invention.
Figure 3B:
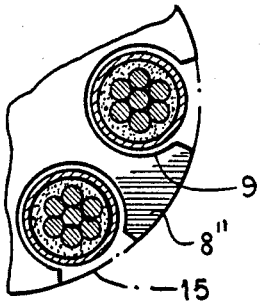

As further shown in FIG. 3 the cables 5 are held in the seats 9 by a retaining ring or belt 15. In FIG. 3 the seats 9 are of a depth roughly corresponding to the diameter of the sheaths 6 so that the belt 15 merely tangents the elements 3. FIG. 3A shows a disk 8′ of very small diameter so that the seats 9 are only about half as deep as the diameter of the sheaths 6, in which case the belt 15 pinches them tightly into place in the cutouts 9. FIG. 3B shows very deep seats 9 in a spacer 8″ so that the belt 15 does not touch them. This last-described arrangement is particularly advantageous when the element 2 is to be wound up on a drum, as it allows the spacer 8″ to move longitudinally somewhat on the elements 3. Such relative movability is also advantageous in a curved or catenary installation as seen in FIG. 1.

Figure 4:
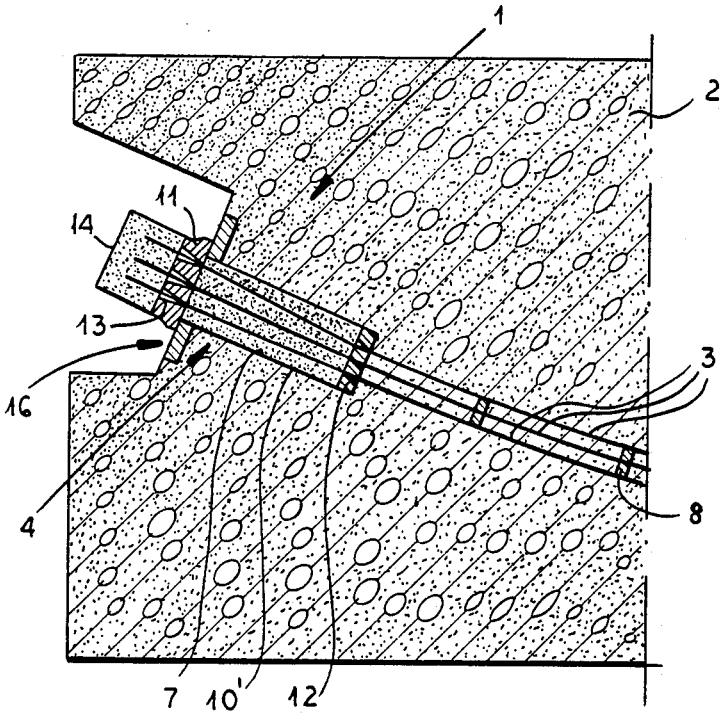
FIG. 4 is a longitudinal section through another variant on the arrangement of this invention.

FIG. 4 shows an arrangement where a tube 10′ is formed purely by the concrete mass 2. An anchor plate 16 formed with the cable holes 13 is inset in a side of this mass 2.

I claim:

1. In a concrete mass, a reinforcement comprising:
   - a group of generally parallel, longitudinally extending, and transversely spaced multifilament cables extending in the mass and each having a pair of longitudinally opposite ends;
   - a respective longitudinally extending resin sheath surrounding each cable between its ends;
   - a plurality of spacers spaced longitudinally along the cables and their sheaths and holding same transversely apart, each spacer being formed with a plurality of outwardly open seats each receiving a respective one of the sheaths, the concrete mass extending between the sheaths;
   - respective belts engaged circumferentially and around each spacer and retaining the cables in the seats of the respective spacer;
   - an anticorrosion and antifriction agent inside each sheath surrounding each cable inside the respective sheath between the respective cable ends; and
   - a respective anchor bracing each cable end against the concrete mass.

2. The reinforcement defined in claim 1 wherein the sheaths are each a synthetic-resin tube.

3. The reinforcement defined in claim 1 wherein the spacers are disks formed with cutouts forming the seats and receiving the respective cables, the disks being slidable along the cables.

4. The reinforcement defined in claim 1 wherein each anchor comprises:
   - a tube having an inner end juxtaposed with the respective ends of the sheaths and an outer end;
   - an elastic plate hermetically engaged between the inner tube end and the respective sheath ends, the cables passing through the elastic plate; and
   - a rigid plate at the outer tube end, the cable being anchored to the rigid plate.

5. The reinforcement defined in claim 4 wherein each anchor further comprises respective wedges jammed between each cable end and the respective rigid plate.

* * * * *